United States Patent [19]

Fox

[11] 4,248,010

[45] Feb. 3, 1981

[54] ILLUMINATED DISC-TYPE THROWING TOY

[76] Inventor: Daniel W. Fox, 202 E. Sharon, Phoenix, Ariz. 85022

[21] Appl. No.: 59,770

[22] Filed: Jul. 23, 1979

[51] Int. Cl.[3] ..... A63H 33/26

[52] U.S. Cl. ..... 46/228; 46/74 D; 273/424

[58] Field of Search ..... 46/228, 226, 74 D; 273/424, 425

[56] References Cited

U.S. PATENT DOCUMENTS

| | | | |
|---|---|---|---|
| 2,826,860 | 3/1958 | Ashley et al. | 46/74 DX |
| 3,000,138 | 9/1961 | Tagliaferri | 46/228 X |
| 3,720,018 | 3/1973 | Peterson et al. | 46/228 |
| 3,786,246 | 1/1974 | Johnson et al. | 46/228 |
| 3,948,523 | 4/1976 | Michael | 46/228 X |
| 4,135,324 | 1/1979 | Miller et al. | 46/228 X |

FOREIGN PATENT DOCUMENTS

| | | | |
|---|---|---|---|
| 617855 | 2/1961 | Italy | 46/226 |

*Primary Examiner*—F. Barry Shay
*Assistant Examiner*—Mickey Yu
*Attorney, Agent, or Firm*—Clarence A. O'Brien; Harvey B. Jacobson

[57] ABSTRACT

A disc-type throwing toy generally in the form of a flying saucer which is constructed and illuminated in such a manner to facilitate use of the device at night with the illumination features including peripheral light emitting devices as well as apertured centrally located housing components having inside illumination to closely simulate popular conceptions of a flying saucer.

10 Claims, 6 Drawing Figures

ILLUMINATED DISC-TYPE THROWING TOY

BACKGROUND OF THE INVENTION

1. Field of the Invention

The present invention generally relates to a flying toy of the disc type having a reversely curved flange at the outer peripheral edge and including peripherally spaced light emitting devices associated with the peripheral edge and light emitting centrally located housing portions both above and below the main disc-like body of the toy.

2. Description of the Relevant Art

Disc-type throwing toys have been used extensively for entertainment purposes and developing agility and other skills in the persons using the toy. However, the use of such toys has been restricted to daylight hours or in areas with adequate illumination thereby, effectively precluding the use of such toys along beaches, in parks, and the like, after dark. Some efforts have been made to provide such disc toys with illumination features, but such features have usually materially increased the cost of the toy and adversely affected the weight and flight characteristics thereof. The following U.S. patents are those known to be relevant to this subject matter.

Pat. No. 3,720,018–Mar. 13, 1973
3,786,246–Jan. 1, 1974
3,798,834–Mar. 26, 1974
3,812,614–May 28, 1974
3,948,523–Apr. 6, 1976
4,134,229–Jan. 16, 1979.

SUMMARY OF THE INVENTION

An object of the present invention is to provide an illuminated disc-type throwing toy simulative of popular conceptions of a flying saucer which includes circumferentially spaced light emitting devices around the periphery of the disc and an apertured housing at the center of the toy with interior illumination thereof emitting light through the apertures.

Another object of the invention is to provide a throwing toy in accordance with the preceding object in which the central apertured housing is in the form of a generally semi-sperhical hollow housing member mounted on both the top and bottom surfaces of the toy with the housing members having apertures therein and providing an enclosure for the power source for the light emitting devices which may be in the form of a throwaway battery or a rechargeable battery combined with a rechargeable jack and switch located exteriorly of the housing for access.

A further important object of the invention is to provide a throwing toy in accordance with the preceding objects which enables the toy to be used after dark and enhances the entertaining and skill developing characteristics of the toy by closely simulating popular conceptions of the appearance characteristics of a flying saucer or similar unidentified flying object.

Yet another important object of the present invention is to provide a throwing toy with illumination features incorporated therein which does not adversely affect the flight characteristics of the toy and does not materially increase the cost or weight of the toy thereby enabling the toy to be used by various individuals and enabling the toy to be used after dark as well as during daylight hours.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
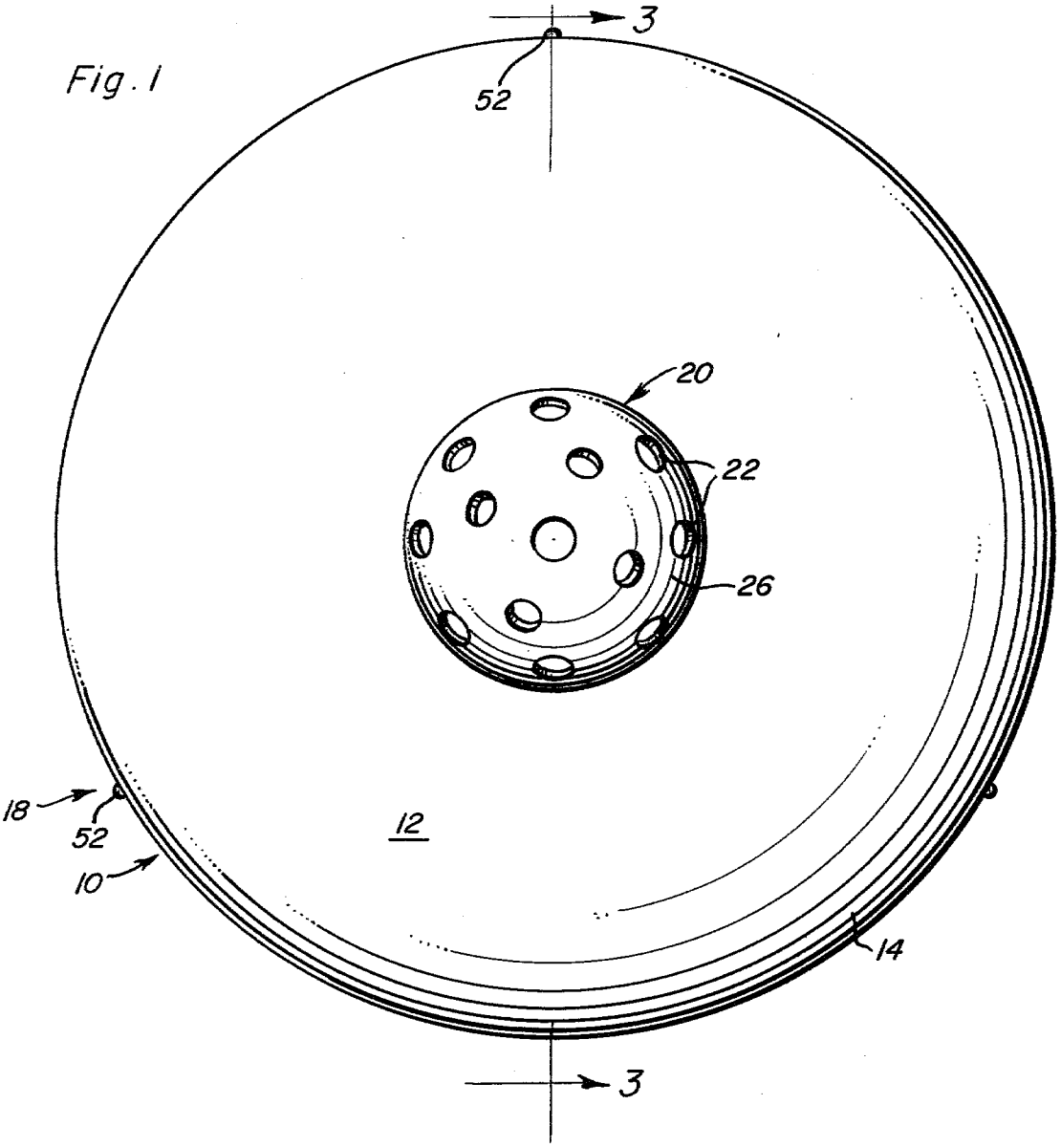
FIG. 1 is a top plan view of the toy of the present invention.
Figure 2:
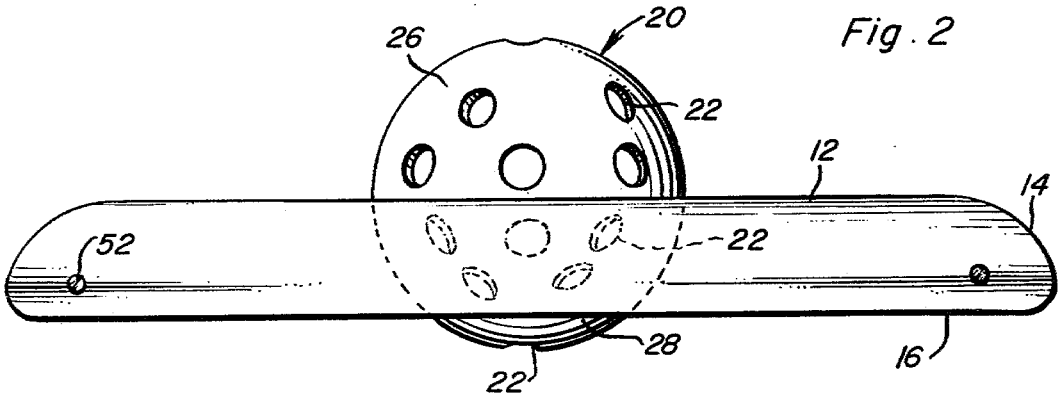
FIG. 2 is a side elevational view thereof.
Figure 3:
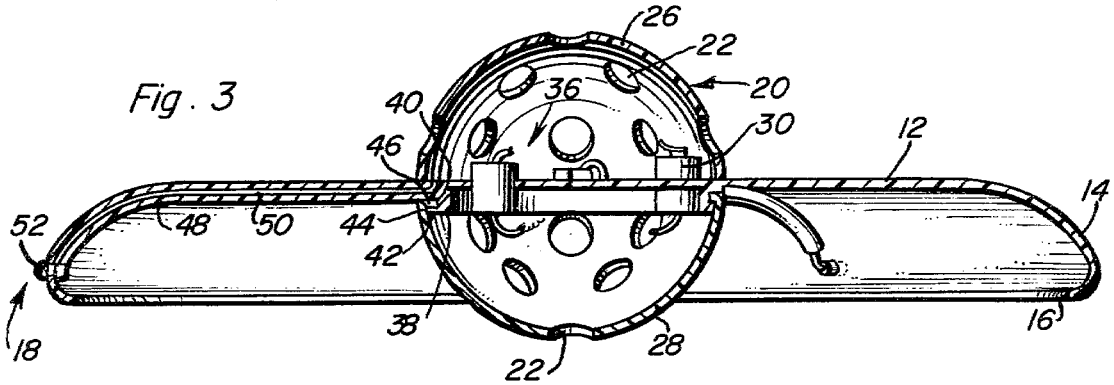
FIG. 3 is a transverse, sectional view, taken substantially upon a plane passing along section line 3—3 of FIG. 1, illustrating the specific structural details of the toy and the central housing components.
Figure 4:
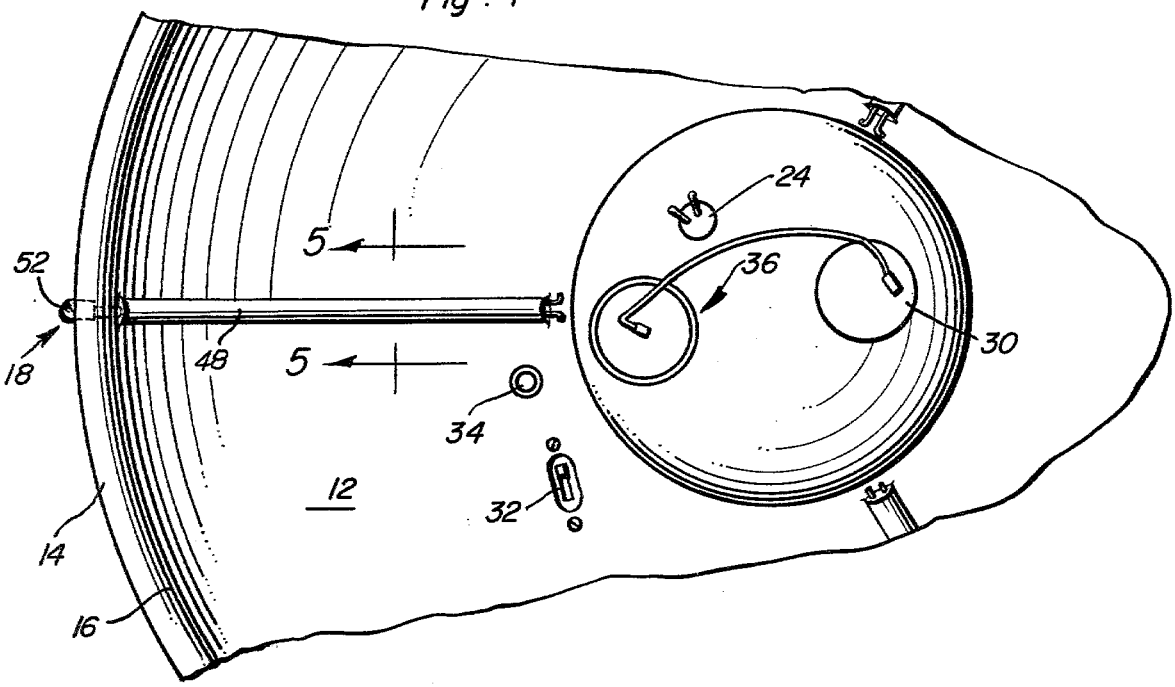
FIG. 4 is a fragmental bottom plan view thereof with the bottom housing component removed illustrating the association of certain of the components of the toy.

The toy of the present invention is generally designated by numeral 10 and includes a substantially circular main body or disc 12 of planar construction with the peripheral edge curving downwardly and inwardly as indicated by numeral 14 and terminating in an inturned edge 16 by which the toy may be grasped and thrown in a well-known manner. The aforedescribed structure is conventional and the exact dimensional relationships, curvature and other structural details of the disc 12, downwardly curved portion 14 and terminal edge 16 may vary and follow present day manufacturing techniques.

The present invention essentially involves the addition of a plurality of light emitting devices generally designated by numeral 18 spaced around the circumference of the toy 10. While three light emitting devices are illustrated, it is pointed out that the actual number of such devices may be varied. With the addition of the light emitting devices 18, persons observing the toy during night flight observe peripherally or circumferentially spaced lights which are of different colors thereby closely simulating the popular conception of flying saucers. In addition to the light emitting devices 18, the central portion of the disc 12 is provided with a hollow housing generally designated by the numeral 20 provided with a plurality of perforations or apertures 22 therein and a light source 24 disposed interiorly of the housing so that light will be emitted through each of the apertures 22. The housing 20 includes upper and lower semi-spherical domes 26 and 28 with the upper dome 26 being preferably integral with and unitary with the disc 12 or permanently attached thereto by any suitable means with the lower dome 28 being detachable therefrom to provide access to certain components of the structure which has been added to a conventional throwing toy.

Figure 6:
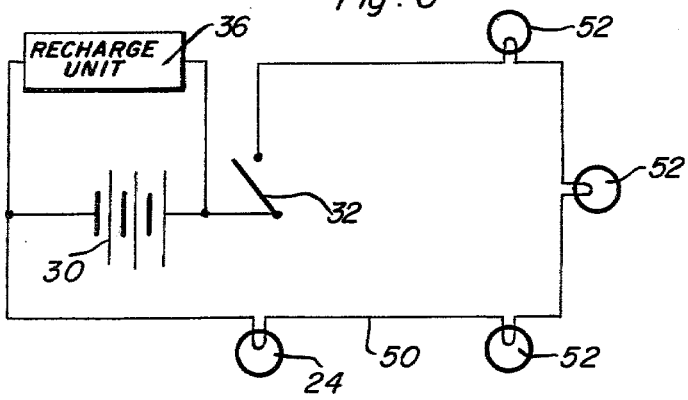
FIG. 6 is a schematic view illustrating the general association of the electrical components of the toy.

The added structure includes a battery 30 located interiorly of the housing 20 with the battery being a conventional component and held in place frictionally or in any other suitable manner with the structure as illustrated including an aperture through the disc 12 frictionally receiving the battery which is commercially available rechargeable battery. In lieu of the rechargeable battery 30, a renewable dry cell battery, such as a conventional nine volt battery, may be employed. A suitable switch 32 is provided on the bottom surface of the panel 12 externally of the housing 20 to provide a manual connection between the battery and the light emitting devices 18 and 24 for energizing these components when desired. When the battery 30 is a rechargeable battery, a rechargeable jack 34 is mounted on the panel 12 with the opening facing downwardly for insertion of a conventional male plug component of a recharging unit that may be connected to a suitable source of electrical energy either AC household current or the source may be a generator or alternator of an automobile, boat, or other similar vehicle. The rechargeable assembly will include conventional electrical components generally designated by numeral 36 mounted interiorly of the housing and connected to the jack 34 and rechargeable battery 30 in a conventional manner as schematically illustrated in FIG. 6 with these components being designated as a recharging unit in the block diagram. This enables the light emitting devices to be actuated from a position externally of the housing and enables the battery to be recharged if a rechargeable assembly is used. The bottom dome 28 of the housing is removable in order to enable replacement of a throwaway or renewable battery and also to enable replacement of the rechargeable battery 30, if necessary, and replacement of any of the components within the housing. The dome 28 is detachably connected to the panel 12 by the use of a depending peripheral flange 38 integral with the panel 12 having a peripheral groove 40 which defines a bottom rib 42 around the periphery of the flange 38. The dome 28 is provided with an internal groove 44 spaced from the edge thereof which defines a rib 46 with the rib 46 being received in the groove 40 and the rib 42 being received in the rib 44 in order to detachably connect the dome 28 to the panel 12. The panel 12 as well as the domes 26 and 28 are constructed of plastic material with the flexibility and resiliency of the plastic material of the dome 28 enabling sufficient deformation thereof to enable frictional mounting and removal of the dome 28.

Figure 5:
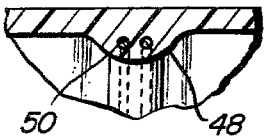
FIG. 5 is a detailed sectional view, taken substantially upon a plane passing along section line 5—5 of FIG. 4, illustrating the manner in which the electrical wires are embedded in the disc toy.

FIG. 5 illustrates the construction of the panel 12 where a slight protuberance 48 is provided along the underside thereof in which electrical wires 50 are disposed with the plastic material of the panel 12 encapsulating the wires 50. The wires 50 interconnect the battery 30 and the light emitting devices 18 which are in the form of light emitting diodes 52, or the like. Also, the light emitting device 24 is in the form of a light emitting diode or any other suitable light bulb connected to the battery by suitable wires. FIG. 6 illustrates schematically the orientation of these light devices. Fiber optics may also be used to transmit light from the central housing 20 to the periphery of the disc. Such fiber optics would include one end terminating flush with the external surface of the toy and defining the peripheral light emitting devices 18 with the inner end of the fiber optics being exposed to a high intensity light bulb disposed interiorly of the housing 20.

With this construction, all of the components may be assembled and molded in one operation, except for the dome 28 which will be a separate component. If desired, the various components may be releasably mounted in place by conventional mounting structures used for electrical components with the device alternately including L.E.D.'s, fiber optics, rechargeable battery or throwaway battery. Also, the structure, other than the electrical components, is preferably constructed of platic material and may be provided with decorative indicia, colors, or the like.

The illumination feature of the present invention enables the toy to be effectively used during periods of darkness thus increasing the use capabilities of a flying saucer toy and also enhances the entertainment characteristics thereof by closely simulating present day conception of the appearance characteristics of a flying saucer, unidentified flying object, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A disc-type throwing toy comprising a generally circular disc having a laterally and reversely curved peripheral edge providing means for grasping the toy and throwing it, first light emitting means mounted on the periphery of the disc, a housing mounted centrally on the disc and projecting laterally from each side thereof, said housing being hollow and including a plurality of openings therein, second light emitting means disposed interiorly of the housing for emitting light through the openings therein, and a power source disposed within said housing selectively connectable by a switch means to said first and second light emitting means so as to selectively energize the same, thereby enabling the throwing toy to be utilized during periods of darkness and enhancing the entertainment characteristics of the toy by closely simulating the popular conception of a flying saucer.

2. The structure as defined in claim 1 wherein said first light emitting means on the periphery of the disc includes a plurality of circumferentially spaced light emitting diodes mounted on the laterally curved peripheral portion of the disc with the diodes being of distinguishable colors and electrically connected to the power source.

3. The structure as defined in claim 1 wherein said first light emitting means at the periphery of the disc includes a plurality of radially extending optical fibers having outer and inner ends, said outer ends terminating in the laterally curved peripheral portion of the disc and said inner ends terminating in the housing, said second light emitting means in the housing including a high intensity light bulb for illuminating the inner ends of the fibers with such illumination of the fibers being emitted from the outer ends thereof.

4. The structure as defined in claim 1 wherein said power source is a throwaway renewable battery.

5. The structure as defined in claim 1 wherein said power source is a rechargeable battery, and a rechargeable jack is disposed externally of the housing on the disc for receiving a plug adapter from a source of electrical energy for recharging the battery.

6. The structure as defined in claim 1 wherein said housing is of generally spherical construction with one half of the housing being integral with the disc, the other half of the housing being removably attached to the opposite side of the disc.

7. The structure as defined in claim 6 wherein said disc includes a peripheral flange telescoped into the interior of the removable half of the housing, said removable half of the housing and the flange including inner engaging rib and groove means to frictionally retain the removable half of the housing in position.

8. The structure as defined in claim 7 wherein said disc and housing are constructed of plastic material with the housing having a radius greater than the total thickness of the disc and laterally curved peripheral portion thereby enabling observation of the apertures in both portions of the housing during flight of the toy thereby enabling the flight characteristics of the toy to be more easily determined and to simulate the appearance of a flying saucer.

9. The structure as defined in claim 2 wherein said light emitting diodes mounted on said peripheral edge of said circular disc are external of and extend outwardly from said peripheral edge.

10. The structure as defined in claims 1 or 9 wherein radially-extending protuberances are provided on said circular disc, said protuberances having electrical wires protectively encased therein, said wires serving to provide an electrical connection between said power source and said first light emitting means.

* * * * *